US011450292B2

(12) United States Patent
Huang

(10) Patent No.: US 11,450,292 B2
(45) Date of Patent: Sep. 20, 2022

(54) CHARGE SHARING CIRCUIT AND METHOD FOR LIQUID CRYSTAL DISPLAY PANEL TO IMPROVE DISPLAY EFFECT

(71) Applicants: HKC CORPORATION LIMITED, Shenzhen (CN); CHONGQING HKC OPTOELECTRONICS TECHNOLOGY CO., LTD., Chongqing (CN)

(72) Inventor: Xiaoyu Huang, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 17/312,947

(22) PCT Filed: Jun. 10, 2020

(86) PCT No.: PCT/CN2020/095314
§ 371 (c)(1),
(2) Date: Jun. 11, 2021

(87) PCT Pub. No.: WO2020/248998
PCT Pub. Date: Dec. 17, 2020

(65) Prior Publication Data

US 2022/0051638 A1 Feb. 17, 2022

(30) Foreign Application Priority Data

Jun. 11, 2019 (CN) ..... 201910500012.3

(51) Int. Cl.
*G09G 3/36* (2006.01)

(52) U.S. Cl.
CPC ..... *G09G 3/3614* (2013.01); *G09G 3/3688* (2013.01); *G09G 2300/0814* (2013.01); *G09G 2300/0823* (2013.01)

(58) Field of Classification Search
CPC ..... G09G 3/36; G09G 3/3611; G09G 3/3614; G09G 3/3622; G09G 3/3625; G09G 3/364;
(Continued)

(56) References Cited

U.S. PATENT DOCUMENTS

2007/0046613 A1* 3/2007 Ha ..... G09G 3/3688 345/98
2009/0109201 A1* 4/2009 Kim ..... G09G 3/3648 345/206
(Continued)

FOREIGN PATENT DOCUMENTS

CN 103745697 A 4/2014
CN 105869594 A 8/2016
(Continued)

OTHER PUBLICATIONS

Feng Liu, The International Searching Authority written Comments, dated Sep. 2020, CN.
(Continued)

*Primary Examiner* — Alexander Eisen
*Assistant Examiner* — Nelson Lam

(57) ABSTRACT

This application discloses a charge sharing circuit and charge sharing method for a display panel and a display panel. The charge sharing circuit includes a controller (250) and n sets of sharing sub-circuits (240), where each set of sharing sub-circuits (240) operates in response to a corresponding one of different polarity driving modes of pixel electrodes of the display panel, each set of sharing sub-circuits (240) includes a plurality of control elements (241),
(Continued)

in a set of sharing sub-circuits (240), each of the data lines is connected to only one control element (241), within the same period of time, the controller drives only one set of sharing sub-circuits to operate, and n≥1.

11 Claims, 6 Drawing Sheets

(58) Field of Classification Search
CPC .. G09G 3/3674; G09G 3/3677; G09G 3/3681; G09G 3/3685; G09G 3/3688; G09G 3/3692; G09G 3/3696; G09G 2300/0823
USPC ..... 345/87–104
See application file for complete search history.

(56) References Cited

U.S. PATENT DOCUMENTS

2010/0315322 A1* 12/2010 Cheng ..... G09G 3/3677 345/99
2015/0015473 A1* 1/2015 Jung ..... G09G 3/3611 345/98
2015/0109347 A1* 4/2015 Wen ..... G09G 3/3607 345/88
2015/0123961 A1* 5/2015 Park ..... G09G 3/3614 345/212
2016/0035301 A1* 2/2016 Neugebauer ..... G09G 3/3648 345/100
2016/0035304 A1* 2/2016 Zheng ..... G09G 3/3648 345/99
2016/0078835 A1* 3/2016 Cho ..... G09G 3/3685 345/212
2016/0125827 A1* 5/2016 Wen ..... G09G 3/3648 345/96

FOREIGN PATENT DOCUMENTS

CN 109196576 A 1/2019
CN 109686335 A 4/2019
CN 110459182 A 11/2019
JP 2014052535 A 3/2014
KR 20080049329 A 6/2008

OTHER PUBLICATIONS

Feng Liu, The International Searching Report, dated Sep. 2020, CN.

* cited by examiner

CHARGE SHARING CIRCUIT AND METHOD FOR LIQUID CRYSTAL DISPLAY PANEL TO IMPROVE DISPLAY EFFECT

CROSS REFERENCE OF RELATED APPLICATIONS

This application claims priority to Chinese Patent Application No. CN201910500012.3, filed with China National Intellectual Property Administration on Jun. 11, 2019 and entitled "CHARGE SHARING CIRCUIT AND CHARGE SHARING METHOD FOR DISPLAY PANEL, AND DISPLAY PANEL", which is incorporated herein by reference in its entirety.

TECHNICAL FIELD

This application relates to the field of display technologies, and in particular, to a charge sharing circuit and method for a display panel, and a display panel.

BACKGROUND

It is to be understood that, the statements herein only provide background information related to this application, and do not necessarily constitute the prior art.

A thin film transistor liquid crystal display (TFT-LCD) is one of main panel displays, which has become an important display platform in electronic products and video products. A main driving principle of the TFT-LCD is as follows: a system mainboard connects a compression signal, a control signal, and a power supply of red, green, and blue resistance display to a connecting terminal on a circuit board through a wire, and after the data is processed by a timing controller (TCON) chip on the circuit board, the circuit board is connected to a display region through a source-chip on film (S-COF) and a gate-chip on film (G-COF), so that the LCD obtains a required power supply and a required signal. Due to properties of liquid crystal materials, applying the same voltage to a liquid crystal for a long time causes polarization of the liquid crystal and abnormal display. Therefore, for display by the TFT-LCD, a reference voltage is required, a voltage higher than the reference voltage is defined as a positive polarity, and a voltage lower than the reference voltage is defined as a negative polarity. During display, the voltage applied to the liquid crystal is switched between the positive polarity and the negative polarity across frames to avoid polarization of the liquid crystal.

During switching of the voltage on a pixel electrode from the positive polarity to the negative polarity, insufficient charging is caused, that is, the voltage on the pixel electrode cannot be switched to a target voltage within a limited charging time.

SUMMARY

This application is intended to provide a charge sharing circuit and charge sharing method for a display panel, and a display panel, to complete charging of a pixel electrode as required.

This application discloses a charge sharing circuit for a display panel. The display panel includes data lines and pixel electrodes. The pixel electrodes have different polarity driving modes. The charge sharing circuit includes: n sets of sharing sub-circuits, where each set of sharing sub-circuits operates in response to a corresponding one of different polarity driving modes of the pixel electrode of the display panel and includes a plurality of control elements, each of the control elements is connected to two of the data lines; and a controller configured to drive the control elements. In a set of sharing sub-circuits, each of the data lines is connected to only one of the control elements. Within the same period of time, the controller drives only one set of sharing sub-circuits to operate. $n \geq 1$.

This application further discloses a charge sharing method for a display panel. The display panel includes data lines and pixel electrodes, and the pixel electrodes have different polarity driving modes. The charge sharing method includes steps of:

detecting a polarity driving mode of the pixel electrodes;

selecting a sharing sub-circuit; and driving a control element of the sharing sub-circuit to be turned on before a next frame is outputted.

The sharing sub-circuits include n sets of sharing sub-circuits, where $n \geq 1$. Control elements of a sharing sub-circuit corresponding to each of the polarity driving modes are connected to two data lines having polarities opposite to each other. Each of the data lines is connected to only one of the control elements of each set of sharing sub-circuits. Within the same period of time, only one set of sharing sub-circuits operates.

This application further discloses a display panel, including a data line, pixel electrodes, a charge sharing circuit, a fanout region, and a source driving chip. The data line is connected to the source driving chip through the fanout region. The pixel electrode has different polarity driving modes. The charge sharing circuit includes n sets of sharing sub-circuits and a controller. Each set of sharing sub-circuits operates in response to the different polarity driving modes of the pixel electrode and includes a plurality of control elements. Each of the control elements is connected to two of the data lines. $n \geq 1$. The controller is configured to drive the control element. In a set of sharing sub-circuits, each of the data lines is connected to only one of the control elements. Within the same period of time, the controller drives only one set of sharing sub-circuits to operate.

In this application, a control element is arranged between two data lines. Before polarities of the two data lines are reversed, the control element allows the two data lines to be connected, neutralizes charges on a corresponding pixel electrode, and then output a data driving signal with a polarity opposite to that of a previous frame to a corresponding data line, so that the corresponding pixel electrode is more rapidly charged to a preset potential faster, improving a display effect of the display panel. Furthermore, for each set of sharing sub-circuits, each of the data lines is connected to only one control element, which is equivalent to that two data lines having polarities opposite to each other form a set, and the data lines of the sets do not interfere with each other, so that extensive uneven distribution of charges is avoided, thereby further improving the display effect.

BRIEF DESCRIPTION OF DRAWINGS

The included accompanying drawings are used to provide further understanding of the embodiments of the present application, constitute a part of the specification, and are used to illustrate implementations of the present application and explain the principle of the present application together with literal descriptions. Apparently, the accompanying drawings in the following description show merely some embodiments of this application, and a person of ordinary skill in the art may still derive other drawings from these accompanying drawings without creative efforts. In the figures.

DETAILED DESCRIPTION OF EMBODIMENTS

It should be understood that, the terms used herein, specific structures, and functional details disclosed herein are intended to describe specific embodiments and merely representative. However, this application may be specifically implemented in many alternative forms, and should not be construed as being limited to the embodiments set forth herein.

In the descriptions of this application, the terms such as "first" and "second" are used only for the purpose of description, and should not be understood as indicating or implying the relative importance or implicitly specifying the number of the indicated technical features. Therefore, unless otherwise stated, a feature defined to be "first" or "second" may explicitly or implicitly include one or more features. "A plurality of" refers to two or more. The terms "include", "comprise" and any variant thereof are intended to cover non-exclusive inclusion. One or more other features, integers, steps, operations, elements, components, and/or a combination thereof may be present or added.

In addition, orientation or position relationships indicated by the terms such as "center", "transverse", "on", "below", "left", "right", "vertical", "horizontal", "top", "bottom", "inside", and "outside" are based on orientation or position relationships shown in the accompanying drawings, and are used only for ease and brevity of illustration and description, rather than indicating that the mentioned apparatus or component must have a particular orientation or must be constructed and operated in a particular orientation. Therefore, such terms should not be construed as limiting of this application.

In addition, unless otherwise clearly specified and defined, terms such as "installation", "interconnection", and "connection" shall be understood in a broad sense, for example, may be a fixing connection, a detachable connection, an integral connection, a mechanical connection, an electrical connection, a direct connection, an indirect connection by using an intermediate medium, or communication between interiors of two components. A person of ordinary skill in the art may understand specific meanings of the terms in this application according to specific situations.

Figure 1:
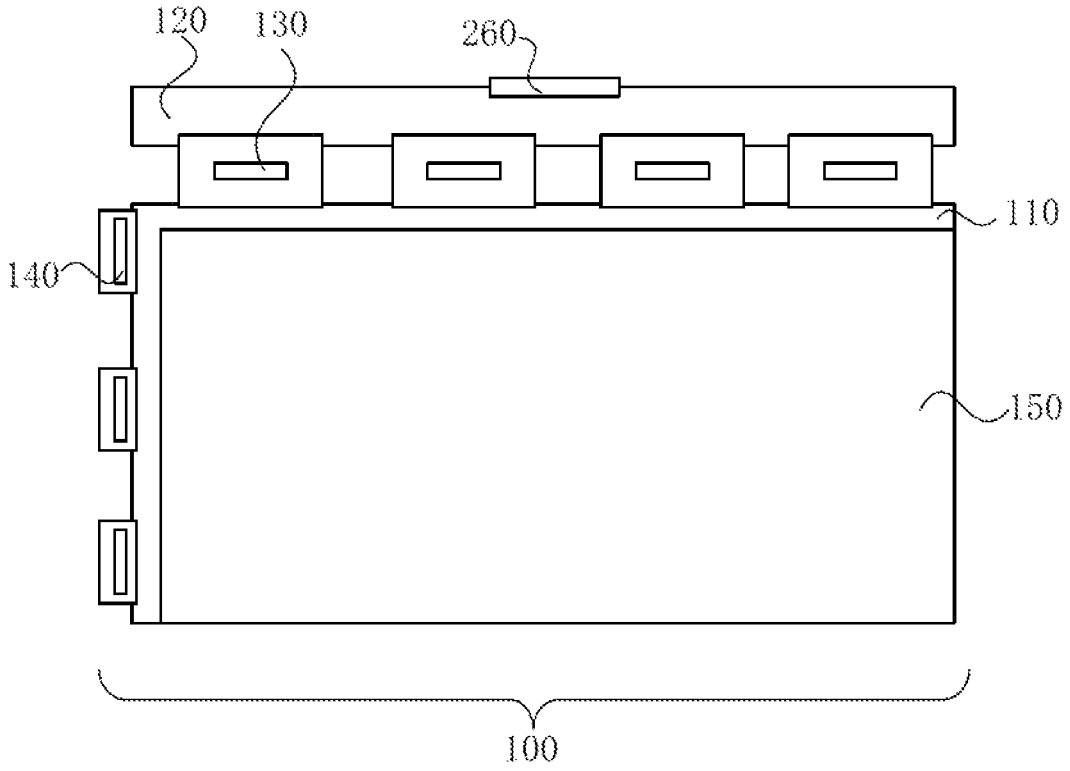
FIG. 1 is a schematic structural diagram of an exemplary display panel.

As shown in FIG. 1, a display panel 100 includes a circuit board 120, a source driving chip 130, a gate driving chip 140, a fanout region 110, and a display region 150. One terminal of the source driving chip 130 is connected to the circuit board 120, and the opposite other terminal is connected to a long side of the fanout region 110. The gate driving chip 140 is connected to a short side of the fanout region 110. A timing controller 260 is arranged on the circuit board 120. After data is processed through the timing controller 260, the circuit board 120 is connected to the display region 150 through the source driving chip 130 and the gate driving chip 140, so that the display panel 100 obtains a required power supply and a required signal.

This application is further described below with reference to the accompanying drawings and optional embodiments.

Figure 2:
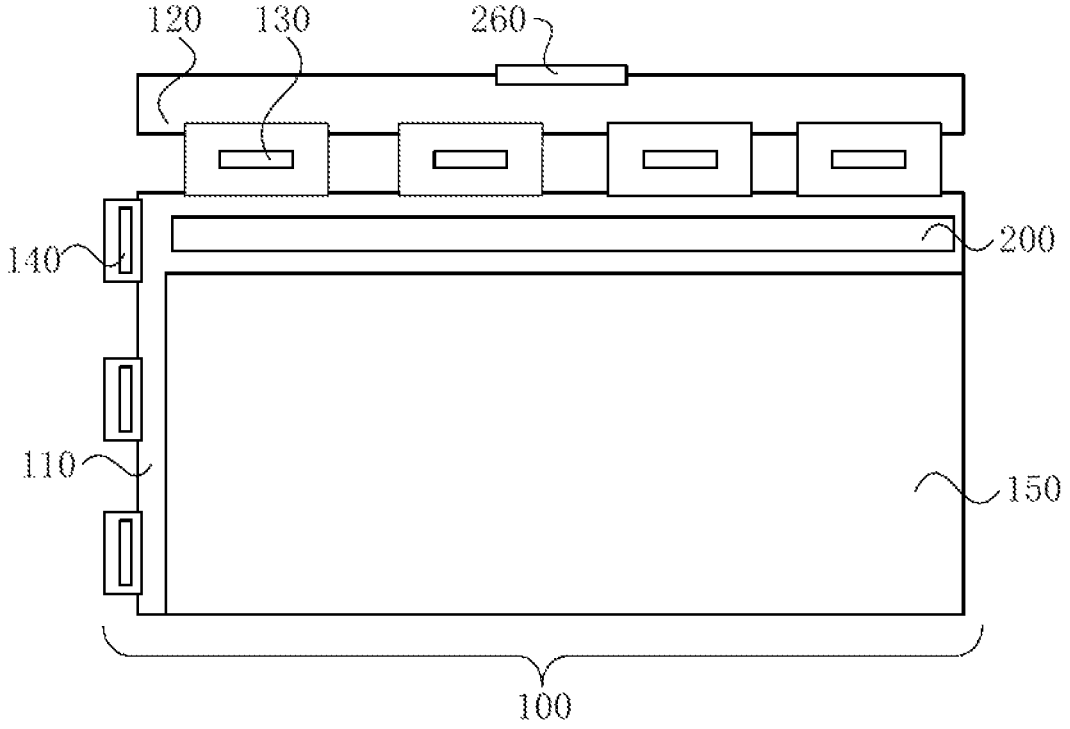
FIG. 2 is a schematic structural diagram of a display panel according to an embodiment of this application.

As shown in FIG. 2, an embodiment of this application discloses a display panel 100. The display panel 100 includes any of the following charge sharing circuits 200, a fanout region 110, and a source driving chip 130. The charge sharing circuit 200 is arranged in the fanout region 110. A size of the display panel 100 is not increased, so that quality of the display panel 100 is improved. Pixel electrodes of the display panel have different polarity driving modes, such as a common mode in which adjacent polarities are reversed (that is, polarities of adjacent four pixels in one row are respectively +−+−) and a mode in which two adjacent polarities of are reversed (that is, polarities of eight adjacent pixels in one row are respectively ++−−++−−). Certainly, the charge sharing circuit 200 is not limited to being arranged in the fanout region 110, as long as the charge sharing circuit is arranged in a non-display region of the display panel. The charge sharing circuit even may be integrated in the source driving chip 130 for controlling charge sharing within a display region outside the display region. The charge sharing circuit is easily manufactured, does not occupy a wiring area in the display region, requires lower accuracy in the display region, and has a simple process.

Figure 3:
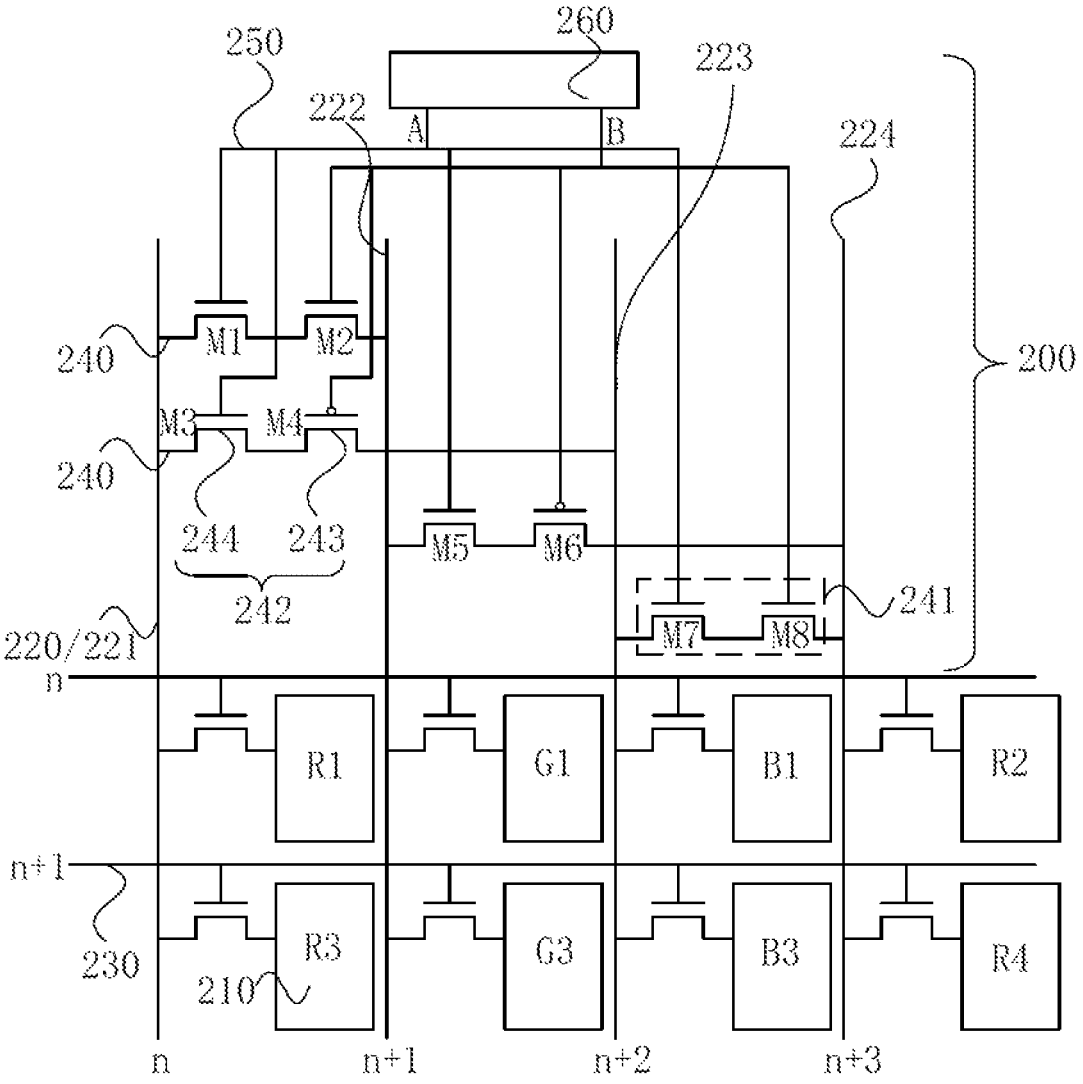
FIG. 3 is a schematic diagram of a charge sharing circuit according to an embodiment of this application.
Figure 4:
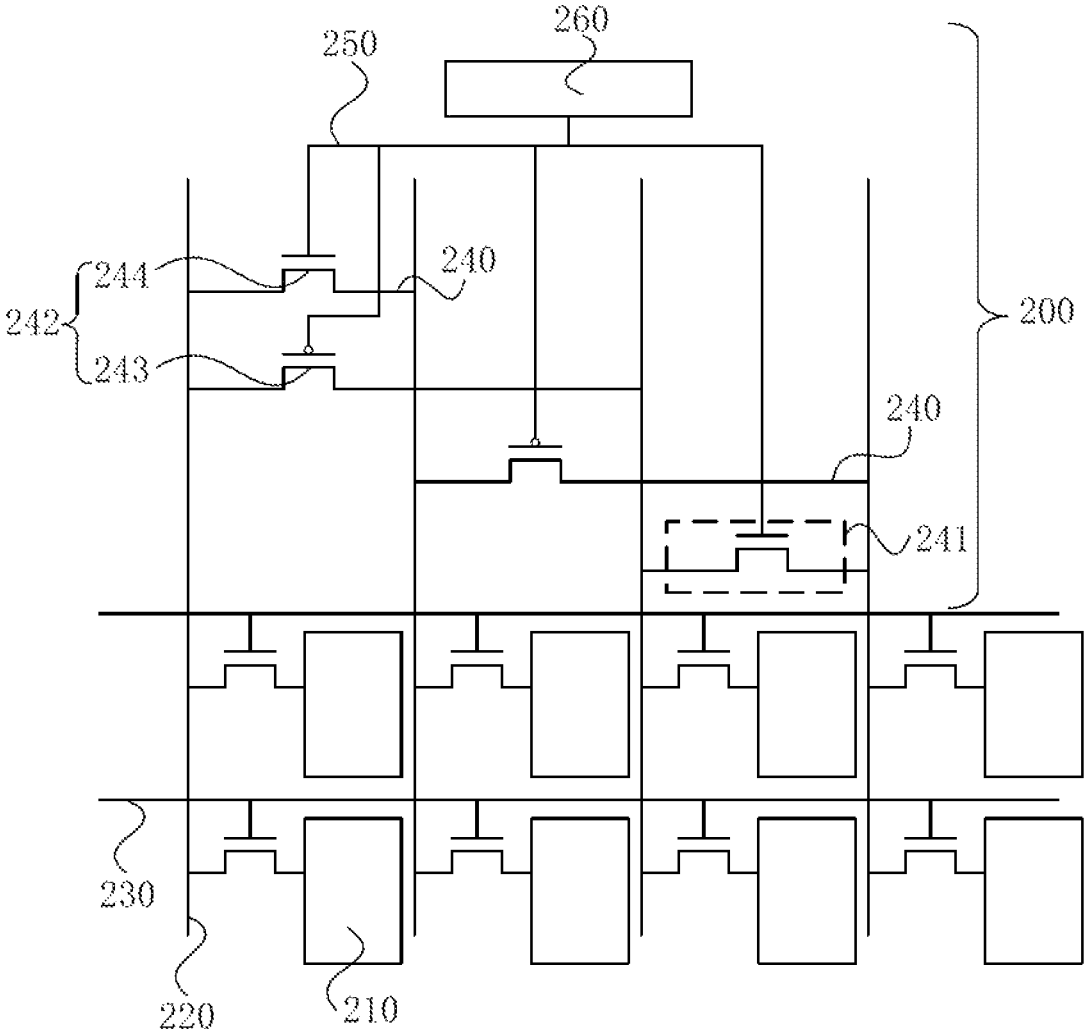
FIG. 4 is a schematic diagram of a charge sharing circuit according to another embodiment of this application.
Figure 5:
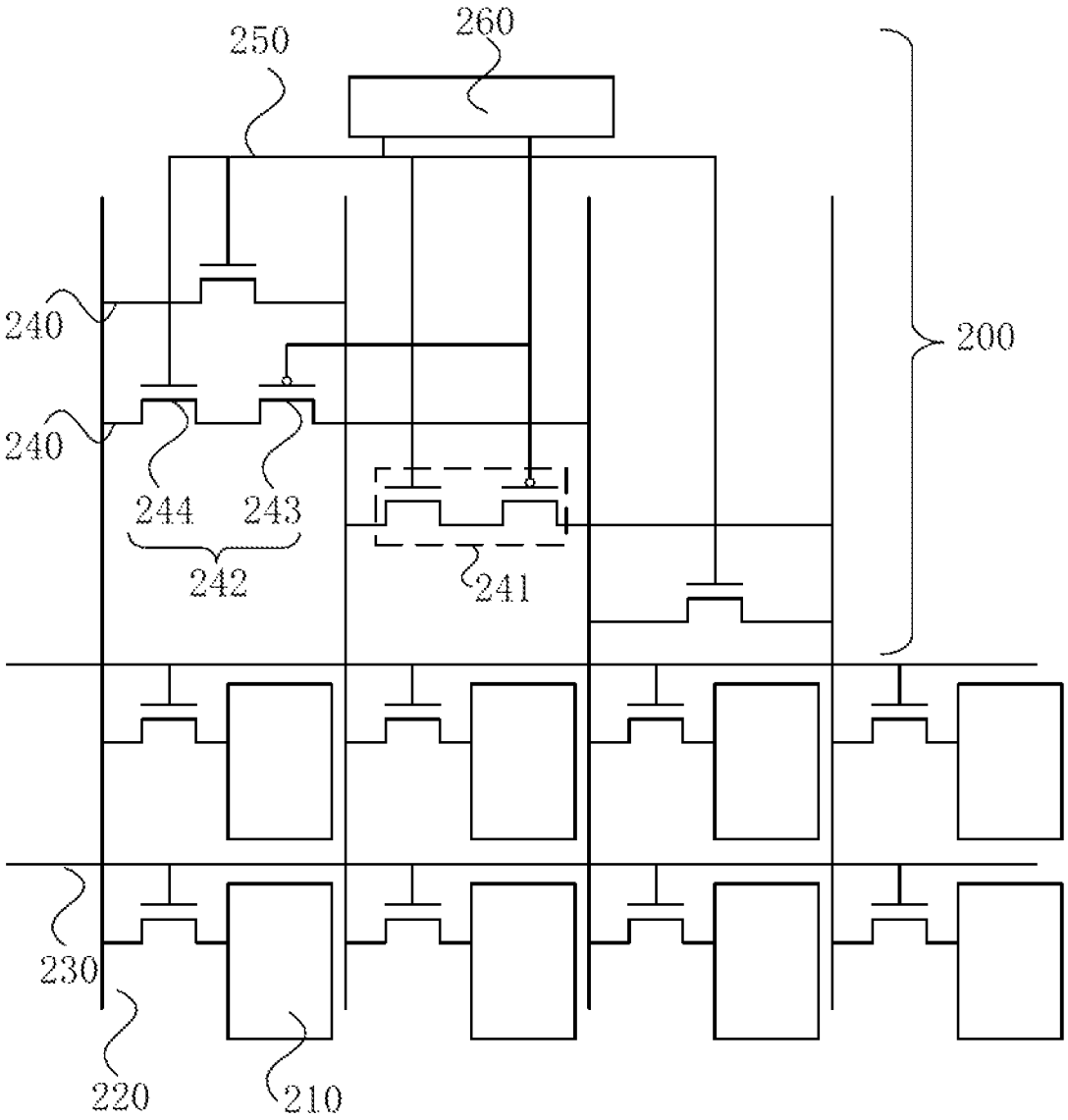
FIG. 5 is a schematic diagram of a charge sharing circuit according to another embodiment of this application.

As shown in FIG. 3 to FIG. 5, the display panel includes: a pixel electrode 210, where the pixel electrode 210 has different polarity driving modes; a scan line 230; and a data line 220 configured to charge the pixel electrode 210. The charge sharing circuit 200 includes n sets of sharing sub-circuits 240. $n \geq 1$. Charging of a corresponding pixel electrode is controlled in such a way that not only a display effect of the product is improved but also costs of the product are reduced.

Each set of sharing sub-circuits 240 operates in response to a corresponding one of different polarity driving modes of the pixel electrode 210. For example, when n=2, four adjacent data lines 220 form one unit. A first set of sharing sub-circuits 240 includes two control elements 241. The sharing sub-circuits 240 are connected to two adjacent data lines 220. A first one of the control elements 241 is connected between a first data line 221 and a second data line 222, and a second one of the control elements 241 is connected between a third data line 223 and a fourth data line 224. The first set of sharing sub-circuits corresponds to a mode in which polarities of adjacent columns are reversed (that is, polarities of four adjacent pixels in one row are respectively +−+−). A second set of sharing sub-circuits 240 also includes two control elements 241. Each of the control elements 241 of the sharing sub-circuits 240 is connected to two data lines 220 that are spaced apart from each other. The first one of the control elements 241 is connected between the first data line 221 and the third data line 223, and the second one of the control elements 241 is connected between the second data line 222 and the fourth data line 224. The second set of sharing sub-circuits 240 corresponds to a mode in which polarities of two adjacent columns are reversed (that is, polarities of eight adjacent pixels in one row are ++−−++−−). Specifically, the sharing sub-circuits 240 include two sets of sharing sub-circuits. The control elements 241 are selected according to detected polarity driving modes to switch on different data lines 220, and through different connected control lines, charges between the data lines 220 are neutralized for charge sharing, so that corresponding pixel electrodes 210 between the data lines 220 of the display panel are charged in a more energy-saving manner.

In one or more embodiments, specifically, each set of sharing sub-circuits 240 includes a plurality of control elements 241. One of the control elements 241 is connected to two data lines 220, and each of the data lines 220 is connected to only one of the control elements 241 of each set of sharing sub-circuits 240. Within the same period of time, only one set of sharing sub-circuits 240 operates. A control element 241 is arranged between two data lines 220. When polarities of the two data lines 220 are to be reversed, the control element 241 allows the two data lines 220 to be connected for sharing a voltage of the pixel electrode 210 connected to the two data lines 220. Before charging of the pixel electrode 210, charges on the pixel electrode 210 are first neutralized to the reference voltage, and then the pixel electrode is charged from the reference voltage to a target voltage to ensure that a charging level of the pixel electrode 210 meets requirements. In addition, one control element 241 can switch on the two data lines 220, which not only reduce manufacturing costs and material costs, but also enables charge sharing between the two data lines 220, thereby improving the display effect of the display panel 100.

In one or more embodiments, specifically, the charge sharing circuit 200 includes a timing controller 260, each of the control elements 241 includes n control switches 242, and n corresponds to a number n of sets of the sharing sub-circuit 240. Each of the control switches 242 is connected to a different one of the control lines 250. The control lines 250 are connected to the timing controller 260. Each of the control switches 242 is separately controlled to be turned on or turned off by separately connecting a different one of the control lines 250 to the timing controller 260 in the display panel 100, thereby controlling sharing sub-circuit 240*s* in a corresponding set to operate and sharing sub-circuits 240 in remaining sets not to operate. It is ensured that the sharing sub-circuits 240 that operate belong to a set between two data lines 220 whose polarities are to be reversed and that the charging level of the pixel electrode 210 meets requirements. The pixel electrode 210 is neutralized to a required voltage, which improves the charging, efficiency, thereby improving the display effect of the display panel 100.

Certainly, the control line 250 may also be connected to an additional controller, and the control switch 242 is controlled to be turned on or turned off through the additional controller in combination with the timing controller 260 in the display panel 100. In this way, interface occupation of the timing controller 260 in the display panel 100 is reduced, and a layout area is reduced.

Specifically, two sets of sharing sub-circuits 240 are used as an example. The control switch 242 is an MOS transistor. The MOS transistor includes a P-type MOS transistor 243 and an N-type MOS transistor 244. Each of the control elements 241 includes two MOS transistors. Each control element 241 in s first set of sharing sub-circuits 240 includes two MOS transistors with the same control logic, that is, two P-type MOS transistors 243 or two N-type MOS transistors 244. Each control element 241 in a second set of sharing sub-circuits 240 includes two MOS transistors with different control logics, that is, one P-type MOS transistor 243 and one N-type MOS transistor 244.

As shown in FIG. 3, more specifically, M4 and M6 are P-type MOS transistors 243. When a signal of the control line 250 is at a high voltage, the P-type MOS transistor 243 is turned off. When the signal of the control line 250 is at a low voltage, the P-type MOS transistor 243 is turned on. M1, M2, M3, M5, M7, and M8 are N-type MOS transistors 244. When the signal of the control line 250 is at a high voltage, the N-type MOS transistor 244 is turned on. When the signal of the control line 250 is at a low voltage, the N-type MOS transistor 244 is turned off. A and B are control signals outputted by the timing controller 260 on the display panel 100. One terminal of M1 is connected to an $n^{th}$ data line 220, the other terminal of M1 is connected to one terminal of M2, the other terminal of M2 is connected to an $(n+1)^{th}$ data line 220. One terminal of M7 is connected to an $(n+2)^{th}$ data line 220, the other terminal of M7 is connected to one terminal of M8, and the other terminal of M8 is connected to an $(n+3)^{th}$ data line 220. One terminal of M3 is connected to the $n^{th}$ data line 220, the other terminal of M3 is connected to one terminal of M4, and the other terminal of M4 is connected to an $(n+2)^{th}$ data line 220. One terminal of M5 is connected to the $(n+1)^{th}$ data line 220, the other terminal of M5 is connected to one terminal of M6, and the other terminal of M6 is connected to the $(n+3)^{th}$ data line 220.

Each set of sharing sub-circuits 240 operates in response to a corresponding one of different polarity driving modes of the pixel electrodes 210. It is assumed that a current polarity driving mode of the display panel is the mode in which the polarities of adjacent columns are reversed, and an $n^{th}$ scan line 230 in FIG. 3 is used as an example for description. If pixel electrodes R1 and B1 corresponding to the $n^{th}$ scan line 230 of a previous frame have a positive polarity and pixel electrodes G1 and R2 corresponding to the $n^{th}$ scan line 230 of the previous frame have a negative polarity, and target voltages of pixel electrodes R1 and B1 of a current frame have a negative polarity and the target voltages the pixel electrodes G1 and G2 of the current frame have a positive polarity, charge sharing is required between adjacent columns before an outputting operation of the data line 220. In this case, the signal A is at a high voltage, and the signal B is at a low voltage, that is, M1, M2, M3, M5, M7, and M8 are turned on, and M4 and M6 are turned off. In this case, the $n^{th}$ data line 220 is connected to the $(n+1)^{th}$ data line 220, and the $(n+2)^{th}$ data line 220 is connected to the $(n+3)^{th}$ data line 220 for charge sharing.

It is assumed that the current polarity driving mode of the display panel is the mode in which the polarities of two adjacent columns are reversed, and an $(n+1)^{th}$ scan line 230 in FIG. 3 is used as an example for description. If pixel electrodes R3 and G3 corresponding to the $(n+1)^{th}$ scan line 230 of the previous frame have a positive polarity and pixel electrodes B3 and R4 corresponding to the $(n+1)^{th}$ scan line 230 of the previous frame have a negative polarity, and target voltages of the pixel electrodes R3 and G3 of the current frame have a negative polarity and the target voltages of B3 and R4 have a positive polarity, charge sharing is required prior to an outputting operation of the data line 220. In this case, the signal A is at a high voltage, and the signal B is at a slow voltage, that is, M1, M3, M4, M5, M6, and M7 are turned on, and M2 and M8 are turned off. In this case, the $n^{th}$ data line 220 is connected to the $(n+2)^{th}$ data line 220, and the $(n+1)^{th}$ data line 220 is connected to the $(n+3)^{th}$ data line 220 for charge sharing.

Generally, polarity driving modes of all rows in a display panel are the same. In this application, control elements of sharing sub-circuits in different sets may be selected to be turned on according to different polarity driving modes. In the above two polarity driving modes, the two data lines 220 whose polarities are to be reversed are switched on prior to an outputting operation of the data lines 220, and the voltage of the pixel electrode 210 is first neutralized to the reference voltage and then charged to the target voltage after an outputting operation of the data lines 220, thereby improving the charging efficiency, ensuring that the charging level of the pixel electrode 210 meets the requirements, and improving the display effect of the display panel 100. However, the structure of the charge sharing circuit 200 of this application may also be arranged to support display panels with different row polarity driving modes. According to determined polarity driving modes in real time, control elements of different sets of sharing sub-circuits are dynamically selected to be turned on during driving of the display panel, which has a wide range of application and high practicability.

Certainly, a method obtained based on the rule is also applicable.

When charge sharing is not required, the signal A is at a low voltage. In this case, M1, M3, M5, and M7 are turned off, and the control elements 241 between the data lines 220 are all turned off.

As shown in FIG. 4, in one or more embodiments, in the two sets of sharing sub-circuits 240, each of the control elements 241 in each set of sharing sub-circuits 240 has only one MOS transistor. The MOS transistors in the two sets of sharing sub-circuits 240 have control logics opposite to each other, that is, one of the two sets is a P-type MOS transistor 243, and the other of the two sets is an N-type MOS transistor 244, and are connected to the same control line 250. Two logic signals outputted via a connection line respectively control the corresponding MOS transistors to be turned on. One set of sharing sub-circuits 240 operates, and the other set of sharing sub-circuits 240 is turned off. When the control line 250 is cut off both the MOS transistors are turned off and the control elements 241 between the data lines 220 are each turned off. In this way, numbers of MOS transistors and control lines 250 can be reduced, and costs of the product can be reduced.

As shown in FIG. 5, in one or more embodiments, a difference from the above embodiment is: in two sets of sharing sub-circuits 240, the first of the two sets of sharing sub-circuits 240 has one control element 241, and correspondingly has only one N-type MOS transistor. The second of the two sets of sharing sub-circuits 240 has two control elements 241, and correspondingly has two MOS transistors with logics opposite to each other: one P-type MOS transistor 243 and one N-type MOS transistor 244. The two MOS transistors are connected to the same control line 250. Two logic signals outputted via the connection line respectively control the corresponding MOS transistors to be turned on. One set of sharing sub-circuits 240 operates, and the other set of sharing sub-circuits 240 is turned off. When the control line 250 is cut off both the MOS transistors are turned off, and the control elements 241 between the data lines 220 are each turned off. Each MOS transistor is separately controlled, so that control accuracy is high, a response speed is high, charge sharing is fast, and a voltage is neutralized to a required voltage, thereby not only improving the display effect of the display panel but also reducing the costs of the product.

Figure 6:
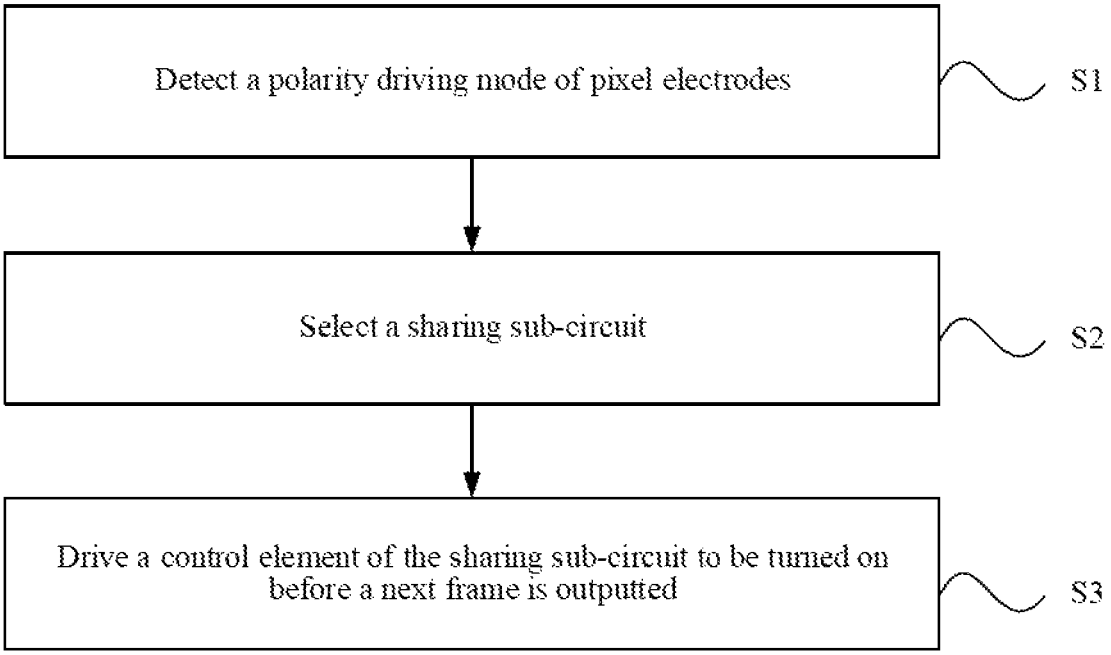
FIG. 6 is a schematic diagram of a charge sharing method for a display panel according to an embodiment of this application.

As shown in FIG. 6, an embodiment of this application discloses a charge sharing method for a display panel. The method includes:

S1: detecting a polarity driving mode of pixel electrodes;

S2: selecting a sharing sub-circuit; and

S3: driving a control element of the sharing sub-circuit to be turned on before a next frame is outputted.

The sharing sub-circuits include n sets of sharing sub-circuits, where $n \geq 1$. A control element of s sharing sub-circuit corresponding to each of the polarity driving mode is connected to two data lines having polarities opposite to each other. Each of the data lines is connected to only one of the control elements of each set of sharing sub-circuits. Within the same period of time, only one set of sharing sub-circuits operates.

Figure 7:
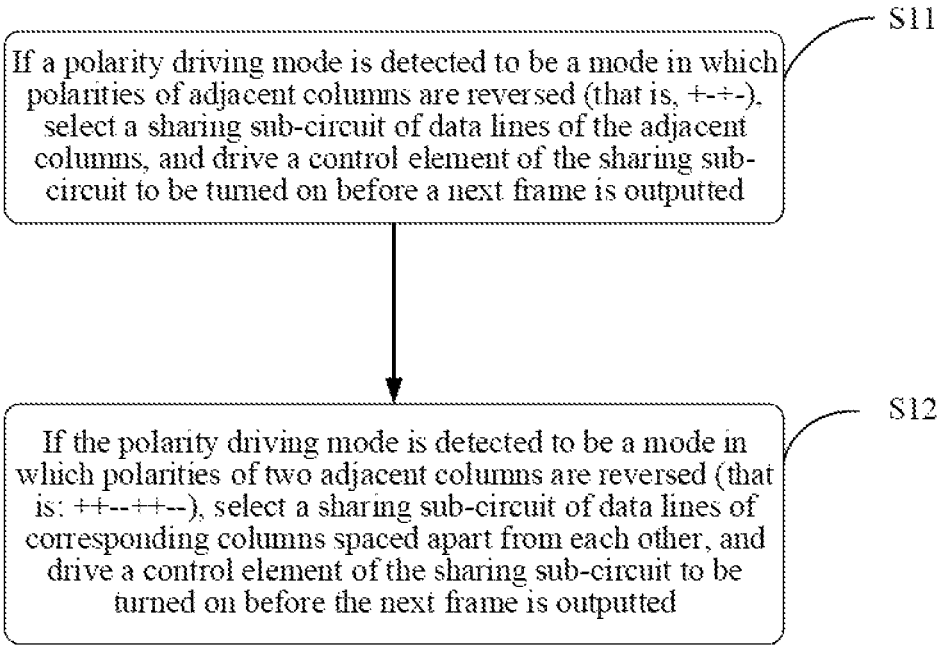
FIG. 7 is a schematic diagram of a charge sharing method for a display panel according to an embodiment of this application.

As shown in FIG. 7, in one or more embodiments, the detecting a polarity driving mode of the pixel electrodes includes steps of:

S11: if a polarity driving mode is detected to be a mode in which polarities of adjacent columns are reversed (that is, +−+−), selecting a sharing sub-circuit of data lines of the adjacent columns, and driving a control element of the sharing sub-circuit to be turned on before a next frame is outputted; and S12: if the polarity driving mode is detected to be a mode in which polarities of two adjacent columns are reversed (that is: ++−−++−−), selecting a sharing sub-circuit of data lines of corresponding columns spaced apart from each other, and driving a control element of the sharing sub-circuit to be turned on before the next frame is outputted.

Figure 8:
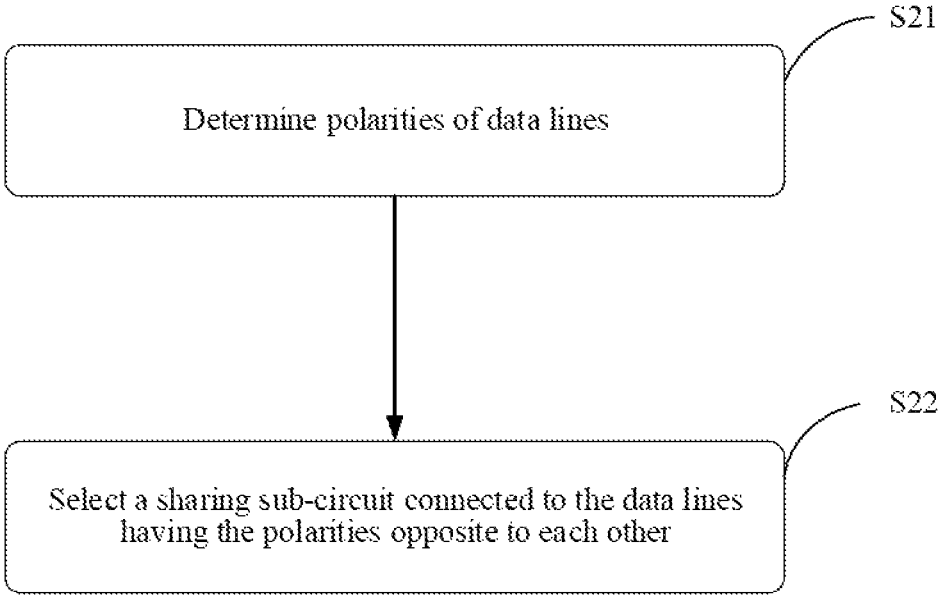
FIG. 8 is a schematic diagram of a charge shaming method for a display panel according to an embodiment of this application.

As shown in FIG. 8, in one or more embodiments, the step of selecting the sharing sub-circuit includes:

S21: determining polarities of the data lines; and

S22: selecting a sharing sub-circuit connected to the data lines having polarities opposite to each other.

It should be noted that on the premise of not affecting the implementation of specific solutions, the descriptions of the steps in this solution shall not be construed as limiting the execution order of the steps. A step mentioned earlier that another step may be executed before, after, or concurrently with the another step.

The foregoing contents are detailed descriptions of this application in conjunction with specific optional embodiments, and it should not be considered that the specific implementation of this application is limited to these descriptions. Persons of ordinary skill in the art can further make simple deductions or replacements without departing from the concept of the present application, and such deductions or replacements should all be considered as falling within the protection scope of the present application.

What is claimed is:

1. A charge sharing circuit for a display panel, wherein the display panel comprises data lines and pixel electrodes, the pixel electrodes are driven by different polarity driving modes, and wherein the charge sharing circuit comprises:

n sets of sharing sub-circuits, wherein each of the n sets of sharing sub-circuits operates in response to a corresponding one of the different polarity driving modes of the pixel electrodes and wherein each of the n sets of sharing sub-circuits comprises a plurality of control elements, each of the plurality of control elements is connected to two of the data lines, and wherein $n \geq 1$; and a controller configured to drive the plurality of control elements of each of the n sets of sharing sub-circuits;

wherein in each set of the n sets of sharing sub-circuits, each of the data lines is connected to only one of the plurality of control elements; and wherein within a same period of time, the controller is configured to drive only one set of the n sets of sharing sub-circuits to operate;

wherein the charge sharing circuit further comprises a timing controller and control lines, and the n sets of sharing sub-circuits comprises a first set of sharing sub-circuits and a second set of sharing sub-circuits; two of the data lines that are connected to each of the plurality of control elements of the first set of sharing sub-circuits are adjacent to each other; two of the data lines that are connected to each of the plurality of control elements of the second set of sharing sub-circuits are spaced apart from each other by one of the data lines in between;

wherein within a same period of time, the data lines connected to the set of sharing sub-circuits that is in an operating state have polarities opposite to each other, wherein two of the data lines whose polarities are to be reversed are coupled to each other prior to an outputting operation of the two data lines, so that voltages of the pixel electrodes connected to the two data lines are neutralized to a reference voltage, before the pixel electrodes are charged to a target voltage subsequent to the outputting operation of the data lines; wherein the data lines connected to the set of sharing sub-circuits that is in a non-operating state have the same polarity;

wherein each of the plurality of control elements in each of the n sets of sharing sub-circuits comprises two control switches, and the two control switches of each of the plurality of control elements in the first set of sharing sub-circuits have a same turn-on control logic; the two control switches of each sharing sub-circuit in the second set of sharing sub-circuits have turn-on control logics opposite to one another; and wherein the controller is integrated in the timing controller, the control lines are connected to the timing controller, and each of the two control switches of each the plurality of control elements of the charge sharing sub-circuit is connected to a corresponding one of the control lines.

2. The charge sharing circuit for the display panel according to claim 1, wherein the control lines comprise two control lines, a first control line and a second control line, and the two control switches of each of the plurality of control elements of each of the first and second sets of sharing sub-circuits are connected to the first control line and the second control line, respectively; and in the two sets of sharing sub-circuits connected to a same data line, the two control switches connected to the first control line have a same turn-on logic, and the two control switches connected to the second control line have turn-on logics opposite to one another.

3. The charge sharing circuit for the display panel according to claim 1, wherein the charge sharing circuit is arranged in a fanout region or integrated in a source driving chip.

4. The charge sharing circuit for the display panel according to claim 1, wherein the control lines are connected to an additional controller, and control switches are controlled to be turned on or turned off through the additional controller in combination with a timing controller in the display panel.

5. The charge sharing circuit for the display panel according to claim 1, wherein each of the two control switches of each of the plurality of control elements in each of the n sets of sharing sub-circuits is separately controlled to be turned on or turned off by separately connecting a different one of the control lines to the timing controller in the display panel.

6. The charge sharing circuit for the display panel according to claim 1, wherein each same data line is connected to two control elements respectively from the two sets of sharing sub-circuits;

when n=2, and four adjacent data lines are taken as a whole, the first set of sharing sub-circuits comprises two control elements, each of the two control elements of the first set of sharing sub-circuits are connected to two adjacent ones of the data lines, a first one of the two control elements is connected between a first data line and a second data line, and a second one of the two control elements is connected between a third data line and a fourth data line;

the first set of sharing sub-circuits corresponds to a mode in which polarities of adjacent columns are reversed;

the second set of sharing sub-circuits also comprises two control elements, each of the two control elements of the second set of sharing sub-circuits are connected to two of the data lines that are spaced apart from each other, a first one of the two control elements is connected between the first data line and the third data line, and a second one of the two control elements is connected between the second data line and the fourth data line;

the second set of sharing sub-circuits corresponds to a mode in which polarities of two adjacent columns are reversed; and the controller controls each of the two control elements in each of the first and the second sets of sharing sub-circuits to be connected through two control lines, and the two control lines are a first control line and a second control line; wherein each of the two control elements of the first set of sharing sub-circuits comprises two MOS transistors which have a same turn-on logic and are respectively connected to the first control line and the second control line, and each of the two control elements of the second set of sharing sub-circuits comprises a P-type MOS transistor connected to the first control line and an N-type MOS transistor connected to the second control line.

7. A charge sharing method for a display panel, wherein the display panel comprises data lines and pixel electrodes, the pixel electrodes are driven by different polarity driving modes; wherein the display panel further comprises a charge sharing circuit, which comprises:

n sets of sharing sub-circuits, wherein each of the n sets of sharing sub-circuits operates in response to a corresponding one of the different polarity driving modes of the pixel electrodes and wherein each of the n sets of sharing sub-circuits comprises a plurality of control elements, each of the plurality of control elements is connected to two of the data lines, and wherein $n \geq 1$; and a controller configured to drive the plurality of control elements of each of the n sets of sharing sub-circuits; wherein in each set of the n sets of sharing sub-circuits, each of the data lines is connected to only one of the plurality of control elements; wherein within a same period of time, the controller is configured to drive only one set of the n sets of sharing sub-circuits to operate; wherein the charging sharing circuit further comprises a timing controller and control lines, and the n sets of sharing sub-circuits comprises a first set of sharing sub-circuits and a second set of sharing sub-circuits; two of the data lines that are connected to each of the plurality of elements of the first set of sharing sub-circuits are adjacent to each other; two of the data lines that are connected to each of the plurality of control elements of the second set of sharing sub-circuits are spaced apart from each other by one of the data lines in between; wherein within a same period of time, the two data lines connected to each of the plurality of control elements of the set of sharing sub-circuits that is in an operating state have polarities opposite to each other, wherein the two data lines whose polarities are to be reversed are coupled to each other prior to an outputting operation of the two data lines, so that voltages of the pixel electrodes connected to the two data lines are neutralized to a reference voltage, before the pixel electrodes are charged to a target voltage subsequent to the outputting operation of the two data line; wherein the two data lines connected to each of the plurality of control elements of the set of sharing sub-circuits that is in a non-operating state have the same polarity; wherein each of the plurality of control elements in each of the n sets of sharing sub-circuits comprises two control switches, and the two control switches of each of the plurality of control elements in the first set of sharing sub-circuits have a same turn-on control logic; the two control switches of each of the plurality of control elements in the second set of sharing sub-circuits have turn-on control logics opposite to one another; wherein the controller is integrated in the timing controller, the control lines are connected to the timing controller, and each of the two control switches of each of the plurality of control elements of the charge sharing sub-circuit is connected to a corresponding one of the control lines:

and wherein the charge sharing method comprises:

detecting a polarity driving mode of the pixel electrodes; and selecting, according to the detected polarity driving mode, the first set sharing sub-circuits or the second set of sharing sub-circuits of which each of the plurality of control elements is connected to two of the data lines which have polarities opposite to each other, and driving the plurality of control elements of the selected first or second set of sharing sub-circuits to be turned on before a next frame is outputted.

8. The charge sharing method for the display panel according to claim 7, wherein the operation of selecting the first set sharing sub-circuits or the second set of sharing sub-circuits of which each of the plurality of control elements is connected to two of the data lines which have polarities opposite to each other comprises:

determining polarities of the data lines; and selecting the first set sharing sub-circuits or the second set of sharing sub-circuits of which each of the plurality of control elements is connected to two of the data lines which have polarities opposite to each other.

9. The charge sharing method for the display panel according to claim 7, wherein the detecting the polarity driving mode of the pixel electrodes comprises:

then the polarity driving mode is detected to be a mode in which polarities of adjacent columns are reversed, selecting the first set of sharing sub-circuits of which each of the plurality of control elements is connected to the data lines of the adjacent columns, and driving the plurality of control elements of the first set of sharing sub-circuits to be turned on before a next frame is outputted; and when the polarity driving mode is detected to be a mode in which polarities of two adjacent columns are reversed in the next two adjacent columns, selecting the second set of sharing sub-circuits of which each of the plurality of control elements is connected to the data lines of corresponding columns spaced apart from each other, and driving the plurality of control elements of the second set of sharing sub-circuits to be turned on before the next frame is outputted.

10. A display panel, comprising data lines, pixel electrodes, a charge sharing circuit, a fanout region, and a source driving chip, wherein the data lines are connected to the source driving chip via the fanout region, the pixel electrodes have different polarity driving modes, and wherein the charge sharing circuit comprises:

n sets of sharing sub-circuits, wherein each of the n sets of sharing sub-circuits operates in response to a corresponding one of the different polarity driving modes of the pixel electrodes and wherein each of the n sets of sharing sub-circuits comprises a plurality of control elements, each of the plurality of control elements is connected to two of the data lines, and wherein $n \geq 1$; and a controller configured to drive the plurality of control elements of each of the n sets of sharing sub-circuits;

wherein in each set of the n sets of sharing sub-circuits, each of the data lines is connected to only one of the plurality of control elements; and wherein within a same period of time, the controller is configured to drive only one set of the n sets of sharing sub-circuits to operate;

wherein the charge sharing circuit further comprises a timing controller and control lines, and the n sets of sharing sub-circuits comprises a first set of sharing sub-circuits and a second set of sharing sub-circuits; two of the data lines that are connected to each of the plurality of control elements of the first set of sharing sub-circuits are adjacent to each other; two of the data lines that are connected to each of the plurality of control elements of the second set of sharing sub-circuits are spaced apart from each other by one of the data lines in between;

wherein within a same period of time, the data lines connected to the set of sharing sub-circuits that is in an operating state have polarities opposite to each other, wherein two of the data lines whose polarities are to be reversed are coupled to each other prior to an outputting operation of the two data lines, so that voltages of the pixel electrodes connected to the two data lines are neutralized to a reference voltage, before the pixel electrodes are charged to a target voltage subsequent to the outputting operation of the data lines; wherein the data lines connected to the set of sharing sub-circuits that is in a non-operating state have the same polarity;

wherein each of the plurality of control elements in each of the n sets of sharing sub-circuits comprises two control switches, and the two control switches of each of the plurality of control elements in the first set of sharing sub-circuits have a same turn-on control logic; the two control switches of each sharing sub-circuit in the second set of sharing sub-circuits have turn-on control logics opposite to one another; and wherein the controller is integrated in the timing controller, the control lines are connected to the timing controller, and each of the two control switches of each the plurality of control elements of the charge sharing sub-circuit is connected to a corresponding one of the control lines.

11. The display panel according to claim 10, wherein each of the plurality of control elements comprises two MOS transistors having a same turn-on control logic or two MOS transistors having different turn-on control logics.

* * * * *